US005520553A

United States Patent [19]

Cecil, Jr. et al.

[11] Patent Number: 5,520,553

[45] Date of Patent: May 28, 1996

[54] CONNECTOR WITH A FRONT END MOUNTED TERMINAL POSITION ASSURANCE SYSTEM

[75] Inventors: Paul D. Cecil, Jr., Joliet; Lawrence E. Geib, Bartlett; Anthony J. Pill, Naperville, all of Ill.

[73] Assignee: Molex Incorporated, Lisle, Ill.

[21] Appl. No.: 352,255

[22] Filed: Dec. 8, 1994

[51] Int. Cl.[6] ..... H01R 13/424

[52] U.S. Cl. ..... 439/595

[58] Field of Search ..... 439/595, 752

[56] References Cited

U.S. PATENT DOCUMENTS

| | | | |
|---|---|---|---|
| 4,797,116 | 1/1989 | Isohata et al. | 439/141 |
| 4,900,271 | 2/1990 | Colleran et al. | 439/595 |
| 4,902,247 | 2/1990 | Suzuki et al. | 439/595 |
| 4,944,695 | 7/1990 | Tsuji et al. | 439/595 |
| 4,998,896 | 3/1991 | Lundergan | 439/595 |
| 5,088,938 | 2/1992 | Murakami et al. | 439/595 |
| 5,108,309 | 4/1992 | Oda et al. | 439/595 |
| 5,127,854 | 7/1992 | Fujitani et al. | 439/595 |
| 5,160,279 | 11/1992 | Sagawa et al. | 439/595 |
| 5,445,541 | 8/1995 | May et al. | 439/595 |

*Primary Examiner*—Gary F. Paumen
*Attorney, Agent, or Firm*—A. A. Tirva

[57] ABSTRACT

A terminal position assurance system is provided for an electrical connector which is adapted to mate with another mateable connecting device. The connector includes a housing having a forward mating end and a rearward terminating end and at least one terminal-receiving cavity extending in a direction between the ends. The forward mating end has an opening for receiving the mateable connecting device. A terminal is insertable into the cavity from the rearward terminating end of the housing. A primary locking arm is provided on the housing in the cavity for movement between a first position when the terminal is fully inserted into the cavity and a second position of incomplete insertion of the terminal. A TPA device is at least partially positioned within the opening at the forward mating end of the housing and includes a passage therethrough for the mateable connecting device. The TPA device is movably between a first position allowing movement of the locking arm and insertion of the terminal and a second position blocking movement of the lock arm away from its first position with the terminal fully inserted. The primary locking arm in its second position blocks movement of the TPA device from its first position to its second position.

9 Claims, 10 Drawing Sheets

CONNECTOR WITH A FRONT END MOUNTED TERMINAL POSITION ASSURANCE SYSTEM

FIELD OF THE INVENTION

This invention generally relates to the art of electrical connectors and, particularly, to an electrical connector which incorporates an improved position assurance system.

BACKGROUND OF THE INVENTION

Generally, an electrical connector includes a dielectric housing mounting at least one electrically conductive terminal therein. The terminal is electrically connected to another circuit component, such as a discrete wire. Connectors often are employed in mateable pairs such that each terminal and the housing of one connector are mateable with a corresponding terminal and the housing of another connector.

The terminals of electrical connectors frequently are very small components, such as components that are stamped and/or formed from thin sheet metal material. A poor quality electrical connection may occur if one or more terminals are not properly seated in its respective housing. The improper seating of a terminal in a housing may occur if the terminal is not fully inserted into the housing during the initial assembly of the connector or if the terminal is vibrated or pulled out of its fully seated condition during use of the connector. Failures of this type are a particular concern in the automotive industry where electrical components are subjected to vibration almost continuously during normal usage and are subjected to direct force during some maintenance. To avoid these problems, the automotive industry often requires connectors to be provided with some form of a terminal position assurance (TPA) system to detect incomplete insertion of the terminals. The automotive industry also generally requires locking means for locking the terminals in the housing, and a TPA system or device also performs this function.

The present invention is directed to providing a TPA system which provides considerable assurance of the detection of incompletely inserted terminals.

SUMMARY OF THE INVENTION

An object, therefore, of the invention is to provide a new and improved terminal position assurance system of the character described.

In the exemplary embodiment of the invention, the system is embodied in an electrical connector adapted to mate with another mateable connecting device. The connector includes a housing having a forward mating and a rearward terminating end and at least one terminal-receiving cavity extending in a direction between the ends. The forward mating end has an opening for receiving the mateable connecting device. A terminal is insertable into the cavity from the rearward terminating end of the housing. A primary locking arm is provided on the housing in the cavity for movement between a first position when the terminal is fully inserted into the cavity and a second position of incomplete insertion of the terminal. The primary locking arm includes a latch for mechanical interconnection with a complementary latch on the terminal when the terminal is fully inserted and the locking arm is in its first position.

The invention contemplates the provision of a TPA device at least partially positioned within an opening at the forward mating end of the housing and including a passage therethrough for the mateable connecting device. The TPA device is movable between a first position allowing movement of the locking arm and insertion of the terminal and a second position blocking movement of the locking arm away from its first position with the terminal fully inserted. The locking arm, in its second position of incomplete insertion of the terminal, blocks movement of the TPA device from its first position to its second position and, thereby, indicates that the terminal is not fully inserted.

The invention also contemplates that a secondary locking means be provided between the TPA device and the terminal when the terminal is fully inserted and the TPA device is in its second position. Specifically, the secondary locking means is disclosed as a second locking arm on the TPA device. The primary locking arm and the second locking arm both are pivotally mounted by means providing pivotal movement of the arms in arcs transversely of the insertion direction of the terminal. The primary locking arm has a distal end pivotal in an arcuate path into and out of the path of movement of the TPA device.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENTS

Figure 1:
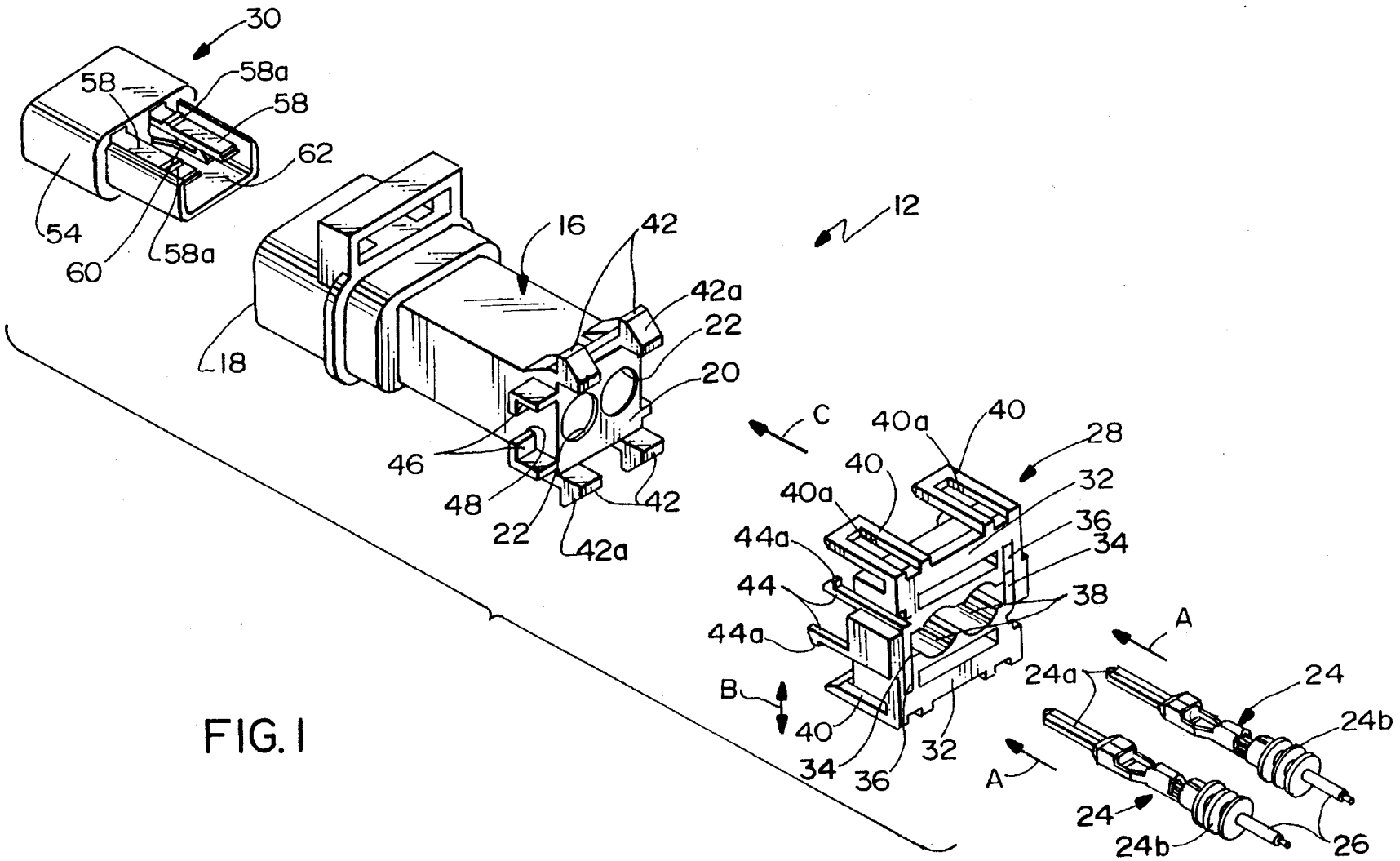
FIG. 1 is an exploded perspective view of a male connector incorporating the TPA device of the invention.

Referring to the drawings in greater detail, FIGS. 1–5 show a male electrical connector, generally designated 12, and FIGS. 6–10 show a mating female electrical connector, generally designated 14. Both connectors incorporate TPA devices embodying the concepts of the invention. Consequently, a detailed description of male connector 12 and its TPA devices first will be presented and, thereafter, a somewhat lesser detailed description of female connector 14 will be presented, because the basic principles of the TPA devices in both connectors are the same.

Turning first to FIG. 1, male connector 12 includes a housing, generally designated 16, which has a forward mating end 18 and a rearward terminating end 20. The housing is unitarily molded of dielectric material such as plastic or the like. A pair of terminal-receiving cavities 22 extend along axes in a direction between the mating and terminating ends of the housing. A pair of terminals, generally designated 24, are insertable into cavities 22 in the direction of arrows "A" from rearward terminating end 20 of housing 16. The terminals have front blade portions **24*a* and rear enlarged portions 24*b*. The terminals are terminated to electrical cables or wires 26**.

A first terminal position assurance ("TPA") device, generally designated 28, is engageable with housing 16 of male connector 12 at rearward terminating end 20 thereof. A second TPA device, generally designated 30, is engageable with housing 16 within forward mating end 18 thereof.

More particularly, rear TPA device 28 is a two-part structure including identical first and second parts 32 having tongue-like flanges 34 press fit within grooves 36 of the opposite part. Therefore, the two parts 32 of TPA device 28 are interconnected for movement relative to each other in the direction of double-headed arrow "B" transversely of the longitudinal axis of the connector. Each part is unitarily molded of dielectric material such as plastic or the like. The two parts of TPA device 28 define a pair of passages 38 therebetween for receiving terminals 24 therethrough when the parts are in their relative open positions described hereinafter. In essence, the two parts of TPA device 28 are movable between open and closed positions in the direction of double-headed arrow "B".

Generally, complementary interengaging latching means are provided between TPA device 28 and housing 16 for mounting the device on the housing in a preloaded condition with parts 32 of the device in their open position. More particularly, referring to FIG. 2 in conjunction with FIG. 1, each part 32 of TPA device 28 includes a pair of flexible cantilevered latch arms 40 having slots **40*a* for snappingly engaging over a pair of latch bosses 42 projecting rearwardly of housing 16 at rearward terminating end 20 thereof. TPA device 28 is mounted to housing 16 in the direction of arrow "C" whereupon the distal ends of latch arms 40 engage camming surfaces 42*a* of latch bosses 42, and the latch arms will embrace the latch bosses with the latch bosses disposed within slots 40*a* of the arms. This preloaded condition of the two-part TPA device is shown in FIG. 2**.

Generally, complementary interengaging locking means are provided between TPA device 28 and housing 16 for locking the two parts of the device in a closed position (described hereinafter) and for locking the device in its final assembled position. More particularly, each part 32 of the two-part TPA device has a pair of flexible cantilevered locking arms 44 having hooked distal ends **44*a*. Housing 16 includes a pair of transversely oriented flanges 46 on each side of the housing, with an opening 48** between the flanges.

Figure 2:
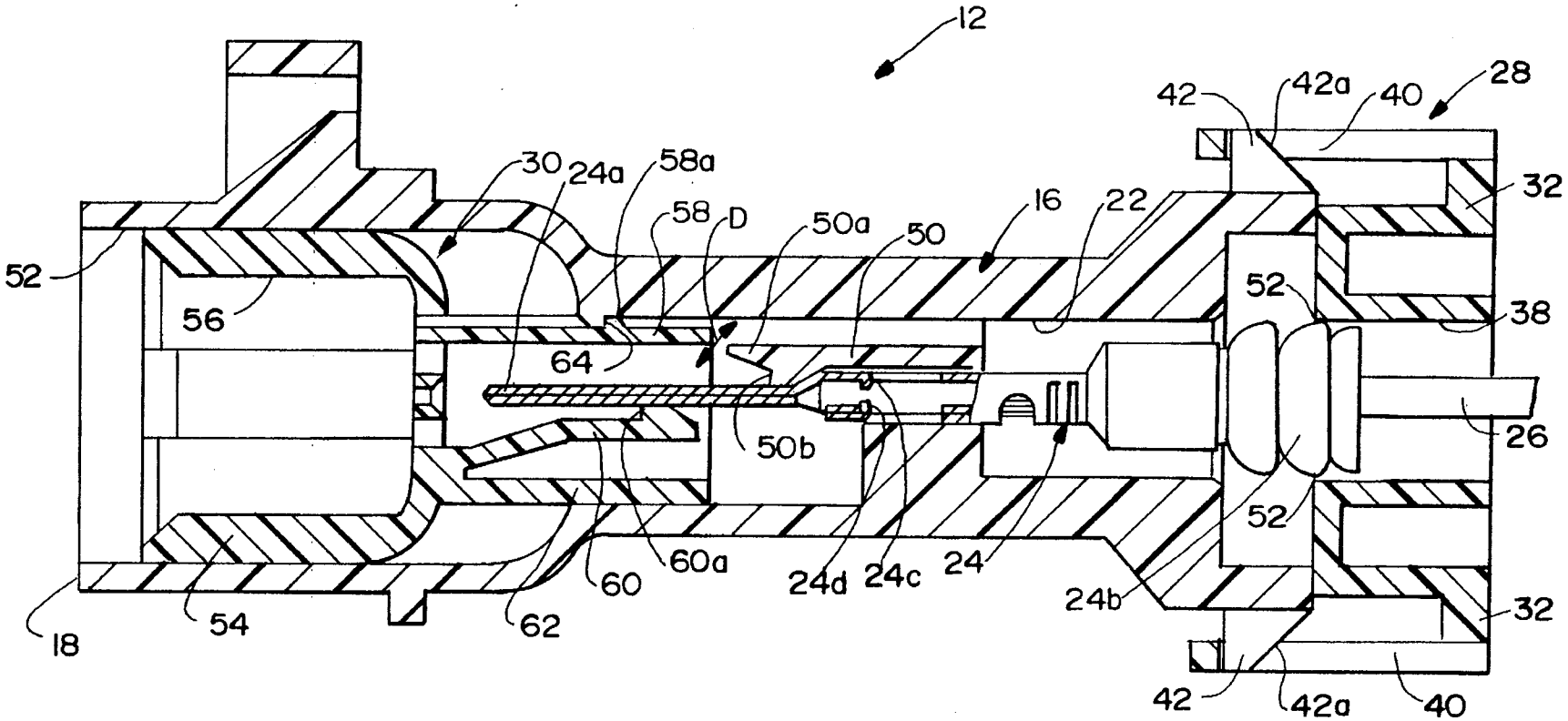
FIG. 2 is an axial section through the male connector, with the two-part TPA device at the rear of the connector in its open position, with the TPA device at the front of the connector in its preloaded position and with the terminal only partially inserted into the connector.

Before proceeding with a description of the operation of two-part TPA device 28, reference is made to FIG. 2 wherein it can be seen that a primary locking arm 50 is formed on housing 16 and is located within each terminal-receiving cavity 22. The locking arm is molded integrally with the housing and includes a distal end **50*a* which is pivotal in an arcuate path as indicated by double-headed arrow "D" transversely of the insertion direction of terminals 24. A locking shoulder 50*b* is provided on the inside of primary locking arm 50 near distal end 50*a* thereof. The locking shoulder is adapted to abut against a top locking shoulder 24*c* as described hereinafter. The terminal also includes a bottom locking shoulder 24*d*** for purposes described hereinafter.

In operation, two-part TPA device 28 first is preliminarily mounted on housing 16 in a preloaded condition as shown in FIG. 2. Latch arms 40 of the TPA device embrace latch arms 42 of connector housing 16 in the preloaded condition of the TPA device. It also should be understood that the two parts 32 of the TPA device are in their transversely open position. In this position, terminals 24 can be inserted through passages 38 between the two parts of the TPA device and into the terminal-receiving cavities 22 of connector housing 16. FIG. 2 shows a condition wherein the terminal 24 illustrated therein is only partially inserted into its cavity. In this position, it can be seen that the two parts 32 of TPA device 28 are in transverse abutting alignment with enlarged portion **24*b* of the terminal, as at 52**. Therefore, the two parts of the TPA device cannot be moved toward each other in the transverse direction which, thereby, indicates a condition of incomplete insertion of the terminal.

Figure 3:
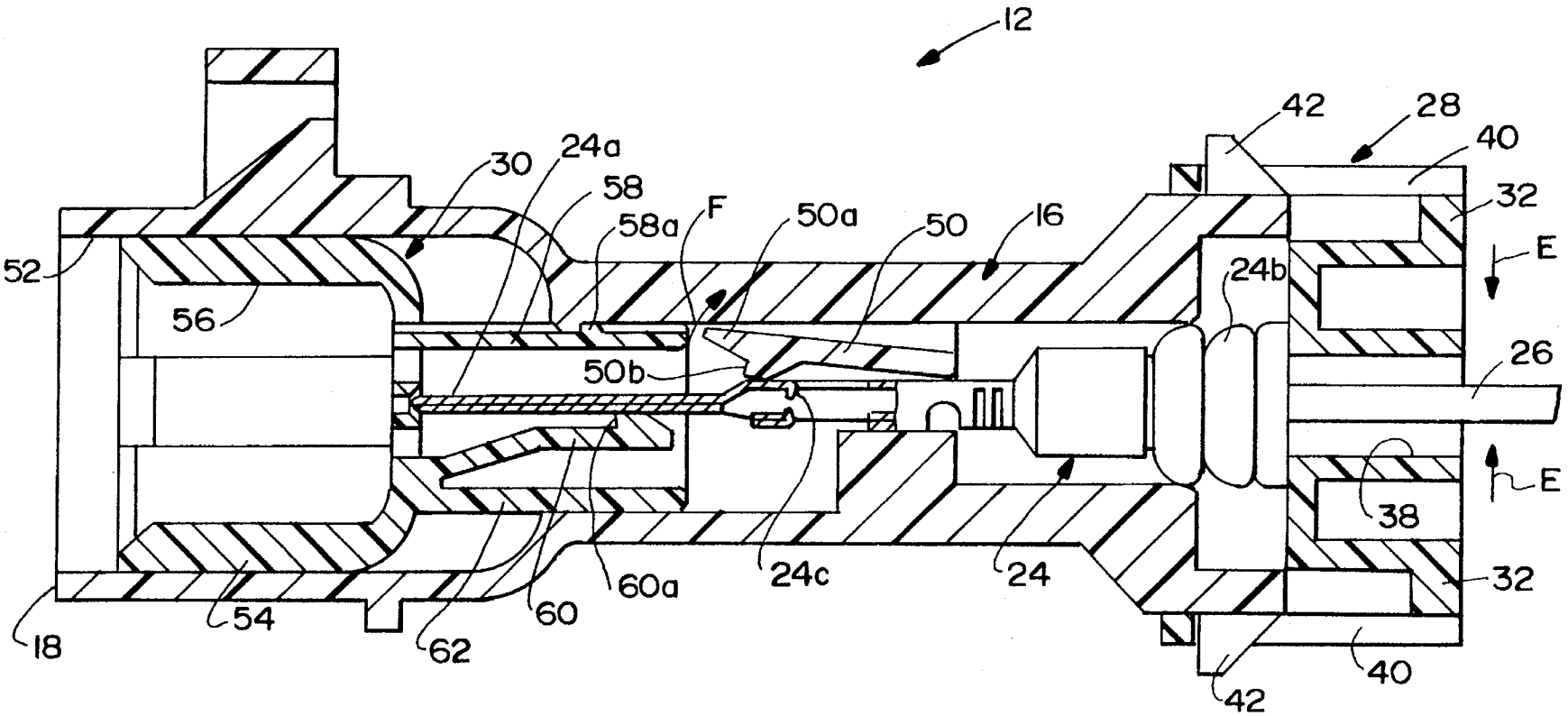
FIG. 3 is a view similar to that of FIG. 2, but with the terminal further inserted into the connector and with the two-part TPA device at the rear of the connector in its closed position.

FIG. 3 shows a condition of terminal 24 and TPA device 28 wherein the terminal still is not fully inserted, but the terminal has been moved sufficiently for the two parts 32 of TPA device 28 to move together or toward each other in the direction of arrows "E" to their closed position. The TPA device, itself, still is in its preloaded condition with latch arms 40 still embracing latch bosses 42 on the connector housing. It also can be seen in FIG. 3 that terminal 24 has cammed the distal end **50*a* of primary locking arm 50 transversely in the direction of arrow "F". However, it should be noted that locking shoulder 50*b* of the primary locking arm still has not engaged top locking shoulder 24*c*** of the terminal.

Figure 4:
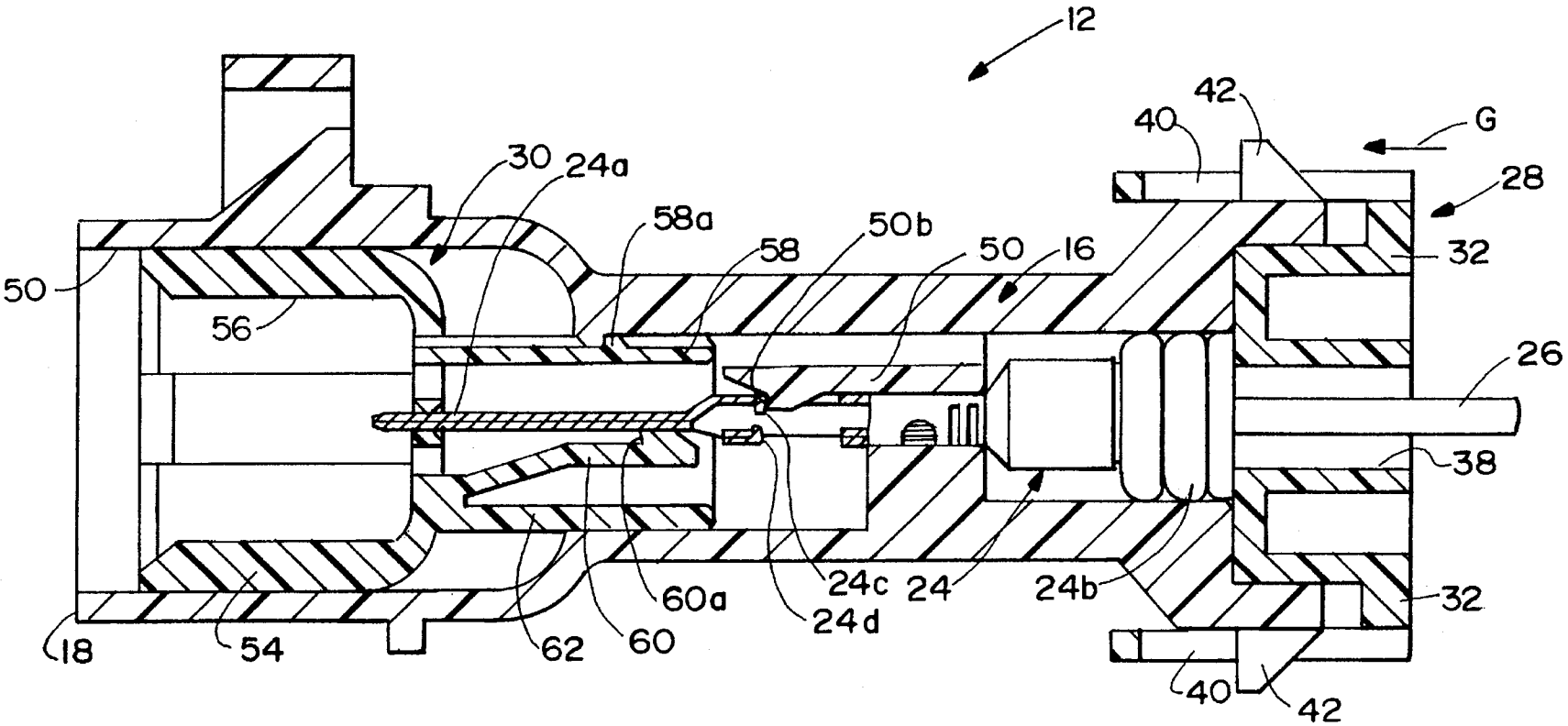
FIG. 4 is a view similar to that of FIG. 3, but with the terminal fully inserted and the two-part TPA device at the rear of the connector moved into its locked position.

FIG. 4 shows a condition wherein TPA device 28 has been moved forwardly in the direction of arrow "G" and terminal 24 is in its fully inserted position, with locking shoulder **50*b* of primary locking arm 50 in locking engagement with top locking shoulder 24*c* of the terminal. It should be understood that terminal 24 in FIGS. 2–4 could have been moved to its fully inserted position as shown in FIG. 4 in the very first instance, as is normally expected. In such instances, the two parts 32 of TPA device then simply would be moved toward each other to their closed position, and the TPA device would be moved forwardly in the direction of arrow "G" (FIG. 4) to its final position without incurring any interference whatsoever with or by the terminal. However, if the terminal is substantially inserted as shown in FIG. 3 but not fully inserted as shown in FIG. 4, the TPA device, itself, can be used to push on the terminal and move the terminal to its fully inserted position. Lastly, when the TPA device is in its final position shown in FIG. 4, hooked distal ends 44*a* (FIG. 1) of locking arms 44 snappingly lock behind flanges 46 on housing 16. This locked condition locks the two parts of the TPA device in their closed position, locks the TPA device in its forward final position and, thereby, also locks the terminal in its fully inserted position due to abutment of the TPA device with the rear of enlarged portion 24*b* of the terminal as seen in FIG. 4. Of course, this is in addition to the primary locking of the terminal afforded by primary locking arm 50**.

Referring back to FIG. 1 in conjunction with FIG. 2, front TPA device 30 of male connector 12 is entirely positionable within an opening 52 at forward mating end 18 of connector housing 16. The TPA device includes a hollow front end 54 defining an interior passage 56. In other words, front end 54 is hollow for receiving a mateable connecting device, as described hereinafter.

TPA device 30 includes a pair of top latch arms 58 and a pair of bottom lock arms 60 all protected by an outer shroud 62. Latch arms 58 have latch hooks 58*a* and lock arms 60 have lock hooks 60*a*. The latch hooks are adapted for latching behind latch shoulders 64 of housing 16 within cavity 22, and lock hooks 60*a* are adapted for locking engagement with bottom locking shoulders 24*d* of terminals 24 as described hereinafter.

In operation of front TPA device 30 of male connector 12, the TPA device is assembled within opening 52 at forward mating end 18 of housing 16 in a first or preloaded position shown in FIG. 2, with latch hooks 58*a* of latch arms 58 interengaged with latch shoulders 64 of the connector housing. In this first or preloaded position of the TPA device, primary locking arm 50 is free to move in the direction of double-headed arrow "D" (FIG. 2) in response to insertion of the terminal.

As seen in FIGS. 3 and 4, front TPA device 34 remains in its first or preloaded position during full insertion of terminal 24 and during the various movements or phases of operation of the two-part rear TPA device 28.

Figure 5:
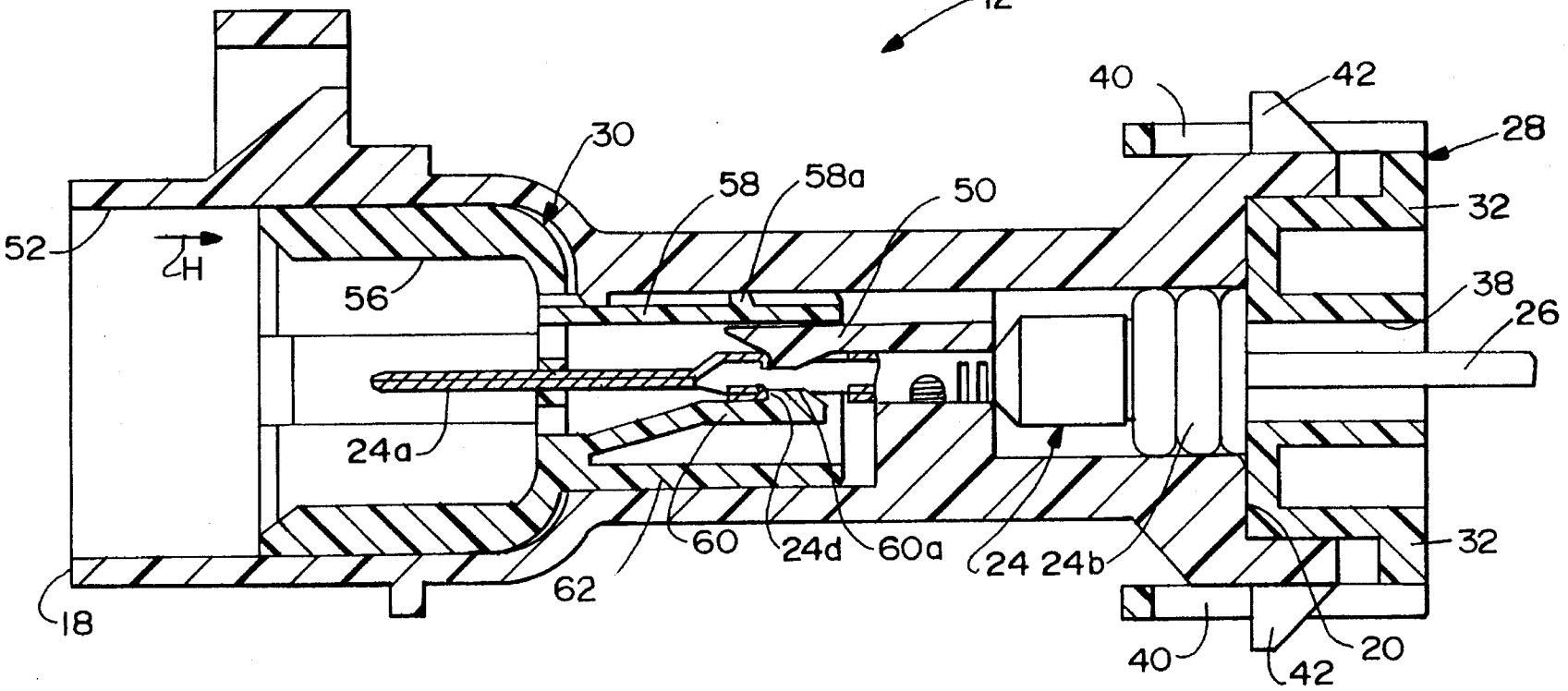
FIG. 5 is a view similar to that of FIG. 4, but with the TPA device at the front of the connector moved to its final position.

Once terminal 24 is fully inserted and rear TPA device 28 is in its final locked position, front TPA device 30 is moved in the direction of arrow "H" in FIG. 5 to a second locking position. In this position, two structural conditions result. First, it can be seen in FIG. 5 that latch arm 58 now blocks movement of primary locking arm 50 out of locking interengagement with terminal 24. Second, hook 60*a* of lock arm 60 is in locking interengagement with bottom locking shoulder 24d of the terminal. Therefore, lock arms 60 provide secondary locking means between front TPA device 30 and the terminals when the terminals are in their fully inserted position and the TPA device is in its second or locking position. Of course, reference is made back to FIG. 3 wherein it can be understood that primary locking arm 50 blocks movement of TPA device 30 if terminal 24 is only partially inserted and, thereby, indicates the incomplete insertion condition of the terminal.

Figure 6:
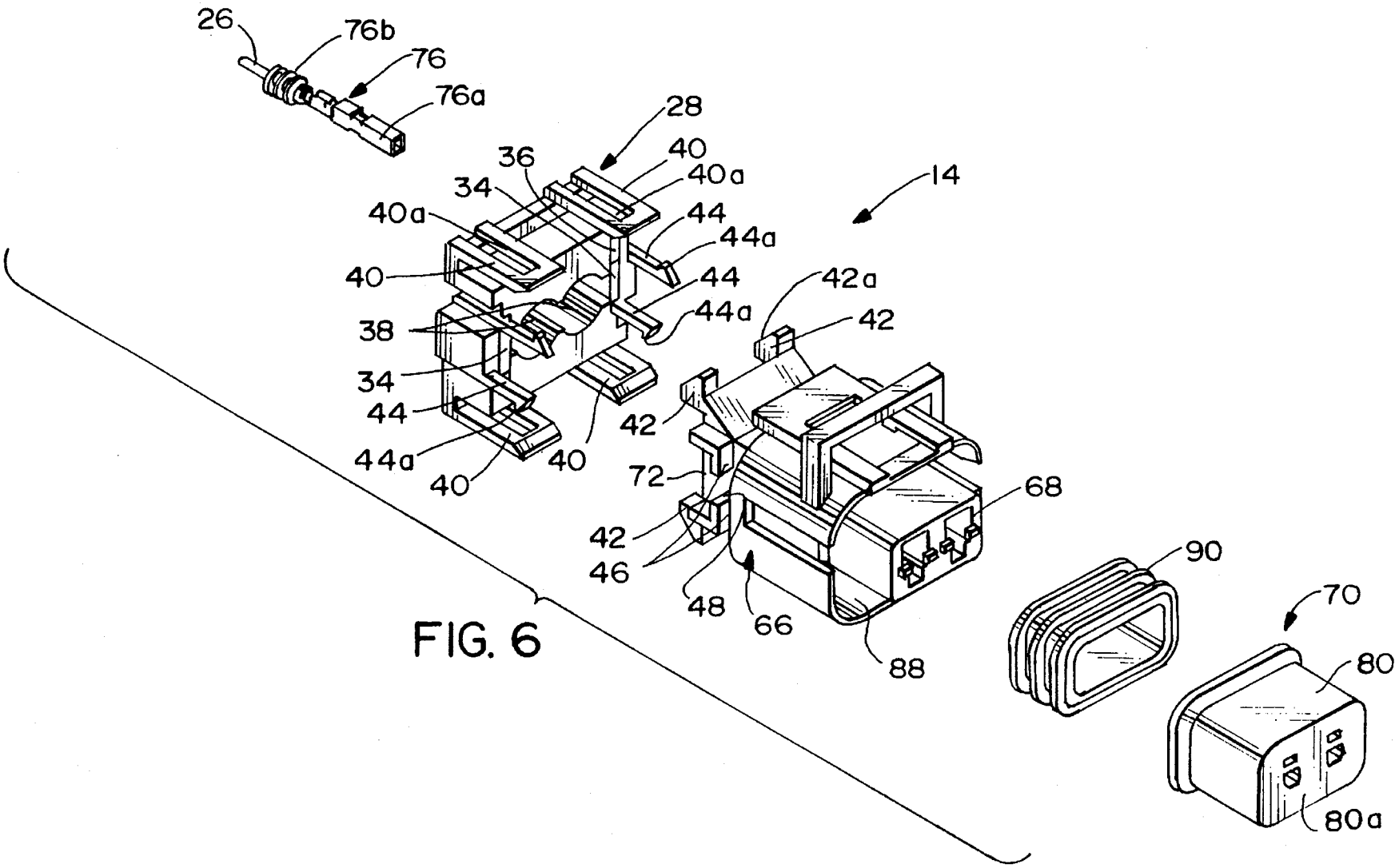
FIG. 6 is an exploded perspective view of a female connector incorporating the TPA device of the invention.

As stated above, FIGS. 6–10 show female connector 14 which incorporates front and rear TPA devices similar or identical to the TPA devices described above as incorporated in male terminal 12 in FIGS. 1–5. In particular, female connector 14 is shown in FIG. 6 to include a housing, generally designated 66, which is unitarily molded of dielectric material such as plastic or the like. The housing has a forward mating end 68 at which a front TPA device, generally designated 70, is interengaged, and a rearward terminating end 72 at which a rear TPA device, generally designated 28, is interengaged. The housing has a pair of terminal-receiving cavities 72 (FIG. 7) for receiving a pair of terminals, generally designated 76. The terminals are similar to terminals 24 in FIGS. 1–5, in that each terminal has a front mating portion 76*a* and a rear enlarged portion 76*b*, with the terminal being terminated to appropriate electrical cables or wires 26. The difference between terminals 76 and terminals 24 is that the front mating portions 76*a* of terminals 76 are of socket configurations for receiving therein appropriate pin terminals, such as the blade portions 24*a* of terminals 24.

Rear TPA device 28 of female connector 14 is identical to rear TPA device 28 of male connector 12 and will not be described in as great a detail at this point. Suffice it to say, TPA device 28 in FIGS. 6–10 include two parts 32 having tongue-like flanges 34 press-fit within grooves 36, and the two parts define passages 38 therebetween. The parts include flexible cantilevered latch arms 40 having slots 40*a* therewithin for engaging latch bosses 42 on female connector housing 66. The parts have flexible cantilevered locking arms 44 with hooked distal ends 44*a* for interengagement with flanges 46 on the female connector housing. TPA device 28 operates and functions on female connector 14 identical to the above description of TPA device 28 on male connector 12. In fact, FIGS. 7–10 can be compared to FIGS. 2–5 and the above descriptions in regard thereto in order to completely understand the operation of TPA device 28 in female connector 14.

Figure 7:
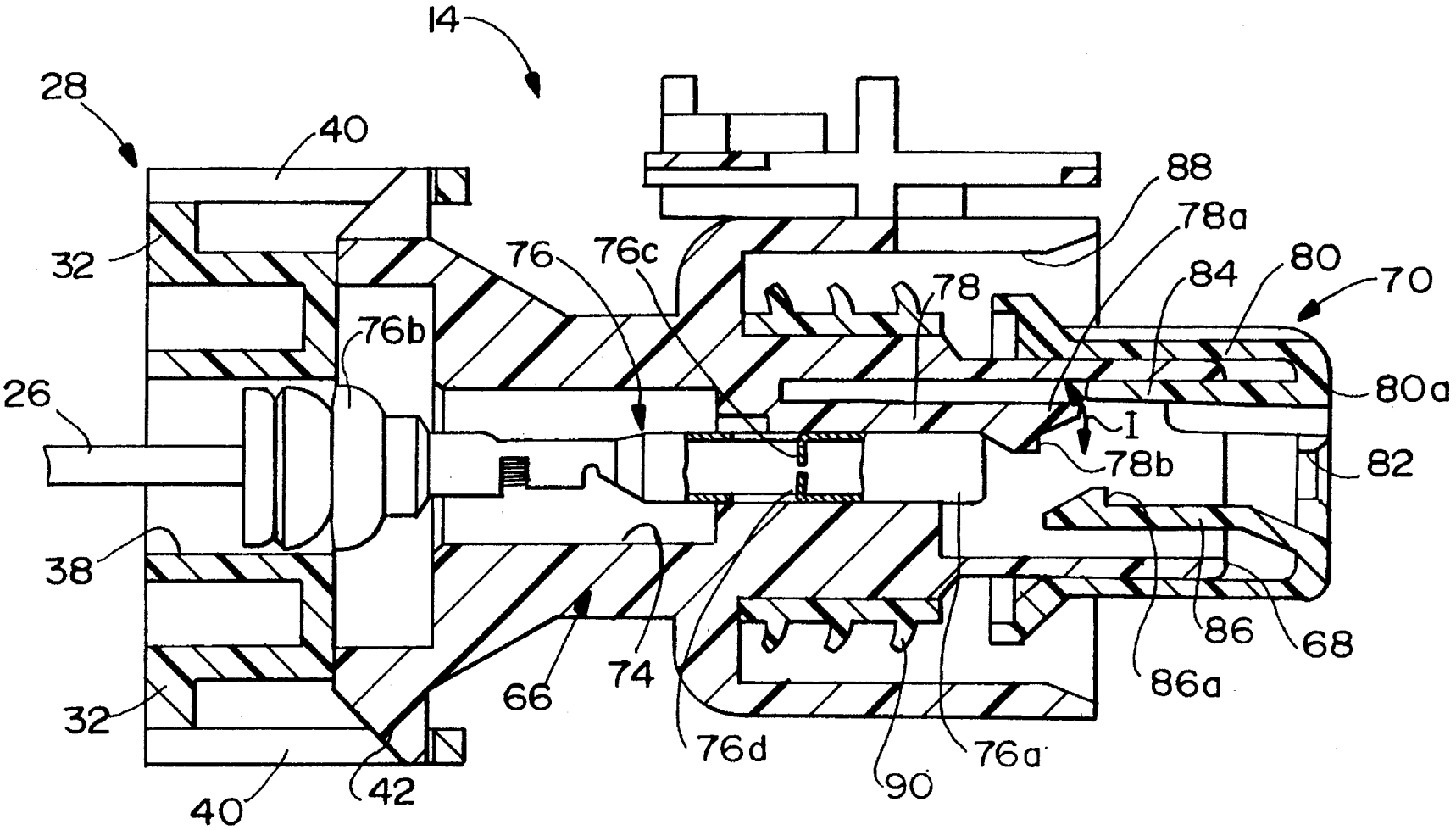
FIGS. 7–10 are views similar to FIGS. 2–5, respectively, showing the same sequential positions of the terminal and the TPA devices for the female connector of FIG. 6.

Before proceeding with a detailed description of front TPA device 70 of female connector 14, reference is made to FIG. 7 wherein it can be seen that housing 66 of the female connector includes a primary locking arm 78 similar in structure and function to primary locking arm 50 of male connector 12. Primary locking arm 78 includes a distal end 78*a* that is pivotal in an arc as indicated by double-headed arrow "I". The locking arm includes a locking shoulder 78*b* for locking interengagement with a top locking shoulder 76*c* of terminal 76. Like terminal 24, terminal 76 includes a bottom locking shoulder 76*d*.

Referring to FIG. 7 in conjunction with FIG. 6, front TPA device 70 of female connector 14 includes a generally hollow front portion 80 having a front face 80*a* defining passages 82 therethrough and through the TPA device at forward mating end 68 of connector housing 66. The passages are adapted for receiving mateable connecting devices, such as blade portions 24*a* of terminals 24 of male connector 12. Upper latch arms 84 and lower lock arms 86 are cantilevered rearwardly within TPA device 70 on opposite sides of passages 82. Lock arms 86 have locking shoulders 86*a* for locking engagement with bottom locking shoulders 76*d* of terminals 76. TPA device 70 is at least partially positionable in an opening 88 at the forward mating end of housing 66. A ribbed seal 90 is located within opening 88.

Figure 8:
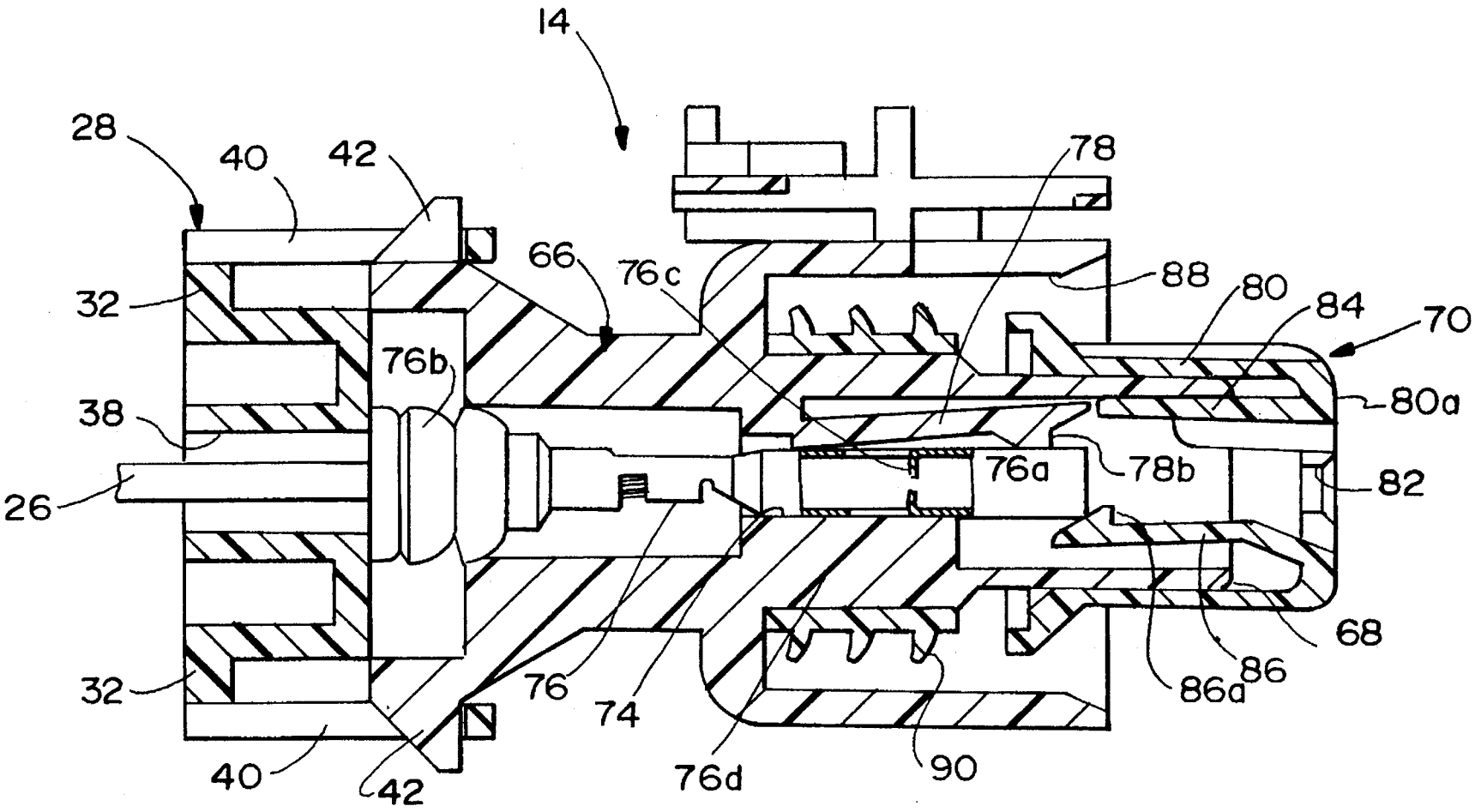
Figure 9:
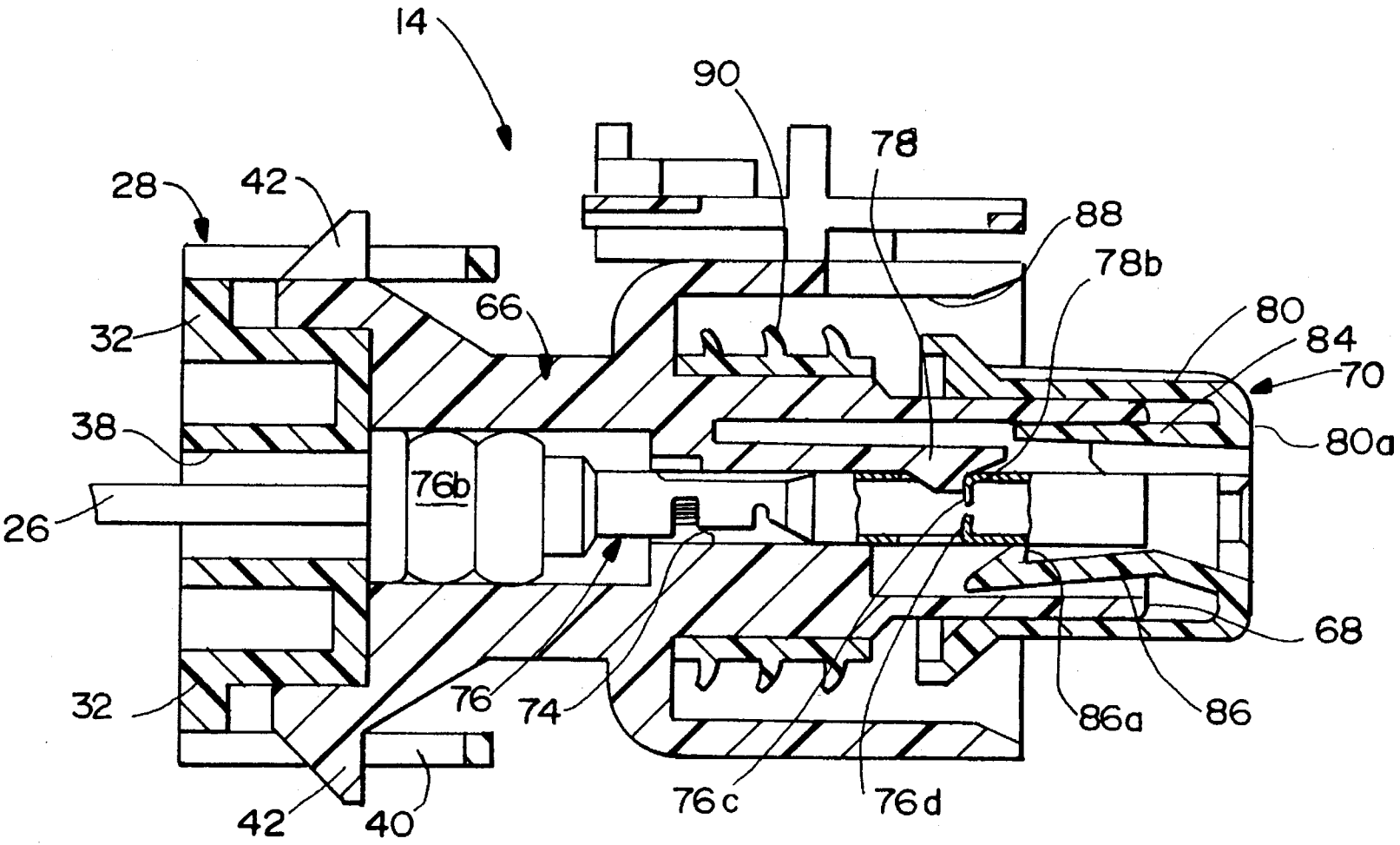
Figure 10:
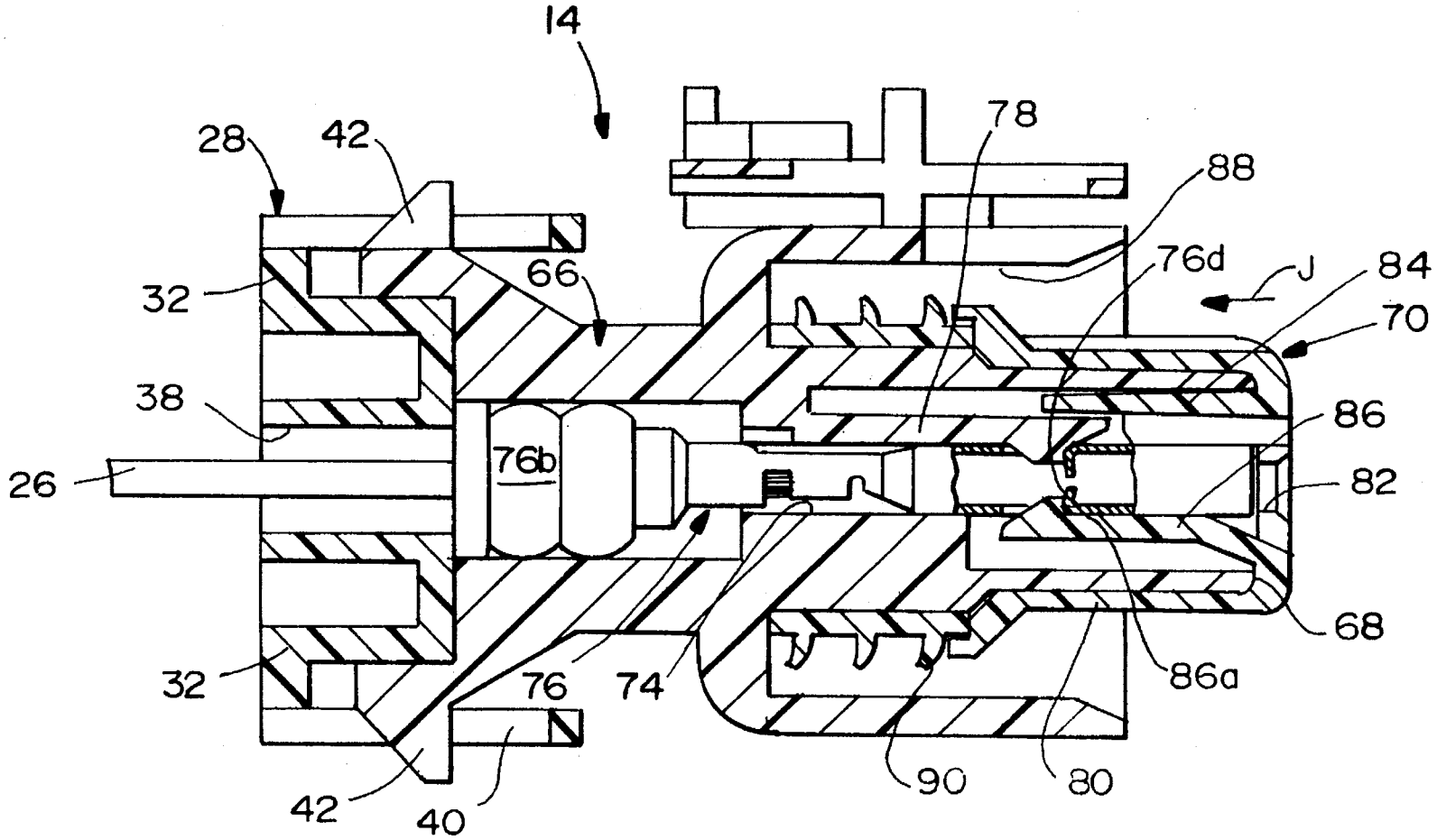

Front TPA device 70 of female connector 14 is movable between a first position shown in FIGS. 7–9 and a second position shown in FIG. 10. In the first position of FIGS. 7–9, it can be seen that latch arms 84 within the TPA device allow free movement of primary locking arm 78 and full insertion of terminal 76. Once the terminal is fully inserted, the TPA device is pushed inwardly in the direction of arrow "J" (FIG. 10) to its second position shown in FIG. 10. In this position, like TPA device 30 of male connector 12, TPA device 70 performs two functions. First, latch arm 84 blocks movement of primary locking arm 78 out of its locking interengagement with terminal 76, as shown. Second, hook 86*a* of lock arm 86 now is in locking interengagement against bottom locking shoulder 76*d* of terminal 76.

In summation, it can be understood that the terminal locking and TPA systems of male connector 12 and female connector 14 provide various redundancies to absolutely assure full insertion of the terminals into their respective connectors. This is very important in such applications as the automotive industry wherein secure electrical connections are critical to vehicular operation and personal safety. Of course, primary locking arm 50 of male connector 12 and primary locking arm 78 of female connector 14 are the primary locking mechanisms of the connectors. However, the front TPA devices 30 and 70 both block movement of the primary locking arms away from their locking interengagements with the terminals, and the front TPA devices also provide secondary locking means in the form of their separate lock arms 60 and 86. If one of the terminals is not fully inserted, the front TPA devices cannot be moved to their operative positions because the primary locking arms will block such movement and, thereby, indicate an incomplete terminal insertion condition. Rear TPA devices 28 add still redundant protection for the entire system. The rear TPA devices not only afford an indication of incomplete terminal conditions, but the TPA devices can be used to assist in fully inserting the terminals and providing yet a third locking mechanism for the terminals as described in detail above.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. A terminal position assurance system for an electrical connector adapted to mate with another mateable connecting device, comprising:

said connector including a housing having a forward mating end and a rearward terminating end and at least one terminal-receiving cavity extending in a direction between the ends, the forward mating end having an opening for receiving the mateable connecting device;

a terminal insertable into the cavity from the rearward terminating end of the housing;

a primary locking arm on the housing in the cavity for movement between a first position when the terminal is fully inserted into the cavity and a second position of incomplete insertion of the terminal, the primary locking arm including a latch for mechanically interlocking with a complementary surface on the terminal when the terminal is fully inserted and the locking arm is in its first position; and a TPA device at least partially positioned within the opening at the forward mating end of the housing and including a passage therethrough for the mateable connecting device, the TPA device being movable between a first position allowing movement of said locking arm and insertion of the terminal and a second position blocking movement of the locking arm away from its first position with the terminal fully inserted;

the primary locking arm in its second position blocking movement of the TPA device from its first position to its second position and, thereby, indicating that the terminal is not fully inserted; and further including a secondary locking means between the TPA device and the terminal when the terminal is fully inserted and the TPA device is in its second position.

2. The terminal position assurance system of claim 1 wherein said primary locking arm is pivotally mounted on the housing within the cavity.

3. The terminal position assurance system of claim 1, including complementary interengaging latching means between the TPA device and the housing to preassemble the TPA device in its first position.

4. The terminal position assurance system of claim 1 wherein said secondary locking means include a second locking arm on the TPA device.

5. The terminal position assurance system of claim 4 wherein said primary locking arm and said second locking arm both are pivotally mounted by means providing pivotal movement of the arms in arcs transversely of the insertion direction of the terminal.

6. The terminal position assurance system of claim 1 wherein said primary locking arm is pivotally mounted on the housing and has a distal end pivotal in an arcuate path into and out of the path of movement of the TPA device.

7. A terminal position assurance system for an electrical connector adapted to mate with another mateable connecting device, comprising:

said connector including a housing having a forward mating end and a rearward terminating end and at least one terminal-receiving cavity extending in a direction between the ends, the forward mating end having an opening for receiving the mateable connecting device;

a terminal insertable into the cavity from the rearward terminating end of the housing;

a primary locking means on the housing for movement between a first unlocking position and a second locking position when the terminal is fully inserted into the cavity; and a TPA device at least partially positioned within the opening at the forward mating end of the housing and including a passage therethrough for the mateable connecting device, the TPA device being movable between a first preloaded position and a second fully mounted position;

the primary locking means in its unlocked position blocking movement of the TPA device from its first position to its second position; and further including a secondary locking means between the TPA device and the terminal when the terminal is fully inserted and the TPA device is in its second position.

8. The terminal position assurance system of claim 7, including complementary interengaging latching means between the TPA device and the housing to preassemble the TPA device in its first position.

9. The terminal position assurance system of claim 7, including a second TPA device engageable with the housing at said rearward terminating end thereof, the second TPA device being adapted for abutting a portion of the terminal in the event the terminal is not at least substantially inserted into the cavity to thereby indicate a condition of incomplete insertion of the terminal.

* * * * *